US005558794A

United States Patent [19]

Jansens

[11] Patent Number: 5,558,794

[45] Date of Patent: Sep. 24, 1996

[54] COAXIAL HEATING CABLE WITH GROUND SHIELD

[76] Inventor: Peter J. Jansens, 3 Marcus Avenue, Morehill, Benoi, Transvaal, South Africa

[21] Appl. No.: 319,358

[22] Filed: Oct. 6, 1994

Related U.S. Application Data

[63] Continuation of Ser. No. 923,448, Aug. 3, 1992, abandoned.

[30] Foreign Application Priority Data

Aug. 2, 1991 [ZA] South Africa ..... 91/6100

[51] Int. Cl.[6] ..... H05B 3/00

[52] U.S. Cl. ..... 219/549; 219/528; 219/505; 219/544; 338/214; 338/259; 174/108

[58] Field of Search ..... 219/548, 549, 219/528, 529, 505, 212, 544; 338/214, 259, 243, 270; 174/108, 126.2

[56] References Cited

U.S. PATENT DOCUMENTS

| | | | |
|---|---|---|---|
| 294,148 | 2/1884 | Pope | 174/126.2 |
| 2,140,270 | 12/1938 | Potter | 174/108 |
| 2,529,914 | 11/1950 | Challenner | 338/214 |
| 2,790,053 | 4/1957 | Peterson | 338/214 |
| 3,010,007 | 11/1961 | Theodore et al. | 219/544 |
| 3,355,544 | 11/1967 | Costley et al. | 174/108 |
| 3,364,335 | 1/1968 | Palatini et al. | 219/544 |
| 3,665,095 | 5/1972 | Seguin | 174/108 |
| 3,676,576 | 7/1972 | Dubernet et al. | 174/126.2 |
| 3,683,103 | 8/1972 | Mancino | 174/126.2 |
| 3,764,779 | 10/1973 | Kadoya et al. | 219/201 |
| 3,789,130 | 1/1974 | Parker | 174/108 |
| 3,790,697 | 2/1974 | Buckingham | 174/108 |
| 3,861,029 | 1/1975 | Smith-Johannsen et al. | 338/214 |
| 3,939,299 | 2/1976 | Raw et al. | 174/126.2 |
| 4,028,660 | 6/1977 | Pitts, Jr. | 174/115 |
| 4,200,973 | 5/1980 | Farkas | 219/549 |
| 4,319,952 | 3/1982 | Schjeldahl | 156/510 |
| 4,380,986 | 4/1983 | Latsch et al. | 123/489 |
| 4,429,215 | 1/1984 | Sakai et al. | 219/528 |
| 4,507,546 | 3/1985 | Fortune et al. | 219/497 |
| 4,551,619 | 11/1985 | Lefebvre | 219/528 |
| 4,591,839 | 5/1986 | Charboneau et al. | 340/620 |
| 4,629,869 | 12/1986 | Bronnvall | 219/505 |
| 4,638,114 | 1/1987 | Mori | 174/108 |
| 5,057,812 | 10/1991 | Yukawa et al. | 338/214 |
| 5,111,032 | 5/1992 | Batlimalla et al. | 219/549 |

FOREIGN PATENT DOCUMENTS

| | | | |
|---|---|---|---|
| 1407180 | 6/1965 | France | 219/549 |
| 54-126981 | 10/1979 | Japan | 174/108 |
| 1184656 | 3/1970 | United Kingdom . | |

*Primary Examiner*—John A. Jeffery
*Attorney, Agent, or Firm*—Lowe, Price, LeBlanc & Becker

[57] ABSTRACT

A coaxial heating cable comprising a central electrically conductive heating core is formed from a conductor having a resistance with a positive temperature coefficient of at least 30% at 20° C. An electrically insulating polytetrafluoroethylene sheath surrounds the core, and an outer electrically conductive ground shield encloses the sheath. The ground shield comprises a number of contiguous strands which are helically wound in a single layer around the sheath. The cable preferably has a maximum diameter of 1 mm and the conductive core conveniently has a resistivity of between 0.4 $ohmsm^{-1}$ and 2 $ohmsm^{-1}$. The heating cable may be used in under-carpet heating. The invention extends to a method of forming a coaxial heating cable.

10 Claims, 2 Drawing Sheets

COAXIAL HEATING CABLE WITH GROUND SHIELD

BACKGROUND TO THE INVENTION

This application is a continuation of application Ser. No. 07/923,448 filed Aug. 3, 1992 abandoned.

This invention relates to a coaxial heating cable, and to a method of forming such a cable.

Conventional heating cables used in under-carpet heating, as well as in the heating of electric blankets, arc formed from a resistive core which is surrounded by an electrically insulating sheath. In under*carpet heating, it is desirable that the heating cable be as thin as possible so that it does not cause irregularities on the overlying carpet surface. Thin cables are, however, prone to wear and subject to relatively high surface temperatures. Once the inner core is exposed due to overheating, wear or piercing of the insulating sheath, then adjacent exposed cores may present a fire hazard, causing a short circuit or an electric shock.

SUMMARY OF THE INVENTION

According to a first aspect of the invention there is provided a coaxial heating cable comprising a central electrically conductive heating core formed from a conductor having a resistance with a positive temperature co-efficient, an electrically insulating polymeric sheath surrounding the core, and an outer electrically conductive ground shield enclosing the polymeric sheath.

Preferably, the coaxial heating cable has a maximum outer diameter of 1.5 mm, and more preferably the cable has a maximum outer diameter of 1 mm.

The electrically insulating polymeric sheath is conveniently formed from a polytetrafluoroethylene (PTFE) compound.

Advantageously, the conductive core has a maximum resistivity of 2 $ohmm^{-1}$ at 20° C., and more advantageously the conductive core has a maximum resistivity of 0.4 $ohmm^{-1}$ at 20° C.

Conveniently, the conductive core has positive temperature co-efficient of at least 30% at 20° C. More preferably, the conductive core has positive temperature co-efficient of between 40% and 60% at 20° C.

The conductive core is advantageously a multi-strand true concentric core having a central strand and at least six outer strands.

The material from which the central strand is formed is preferably chosen from a group including copper, nickel-plated copper, tin-plated copper, nickel and nickel steel.

The material from which the outer strands are formed may be chosen from a group including nickel, copper, nickel-plated copper and tin-plated copper.

The ground shield may comprise at least one helically laid electrically conductive strand.

Preferably, the ground shield comprises twenty four contiguous strands which are helically wound in a single layer over the polymeric sheath, and which are bonded around the sheath by means of a resin.

The invention extends to a method of manufacturing a coaxial heating cable comprising the step of forming a central electrically conductive heating core having a resistance with a positive temperature co-efficient, extruding a polymeric sheath over the core, helically laying a plurality of strands around the sheath so as to form an ground shield, and bonding the strands around the sheath.

Preferably, the method includes the step of heating the sheath prior to laying the strands over the sheath.

Conveniently, the method further includes the steps of sensing the outer diameter of the sheath and varying the pitch of helically laying the strands around the sheath to compensate for variation in diameter, so as to provide even coverage of the sheath by the strands.

The pitch may be varied by varying the feeding speed of the sheath, or by varying the speed of rotation of a strand winding device such as a rotary former.

DESCRIPTION OF EMBODIMENTS

Figure 1:
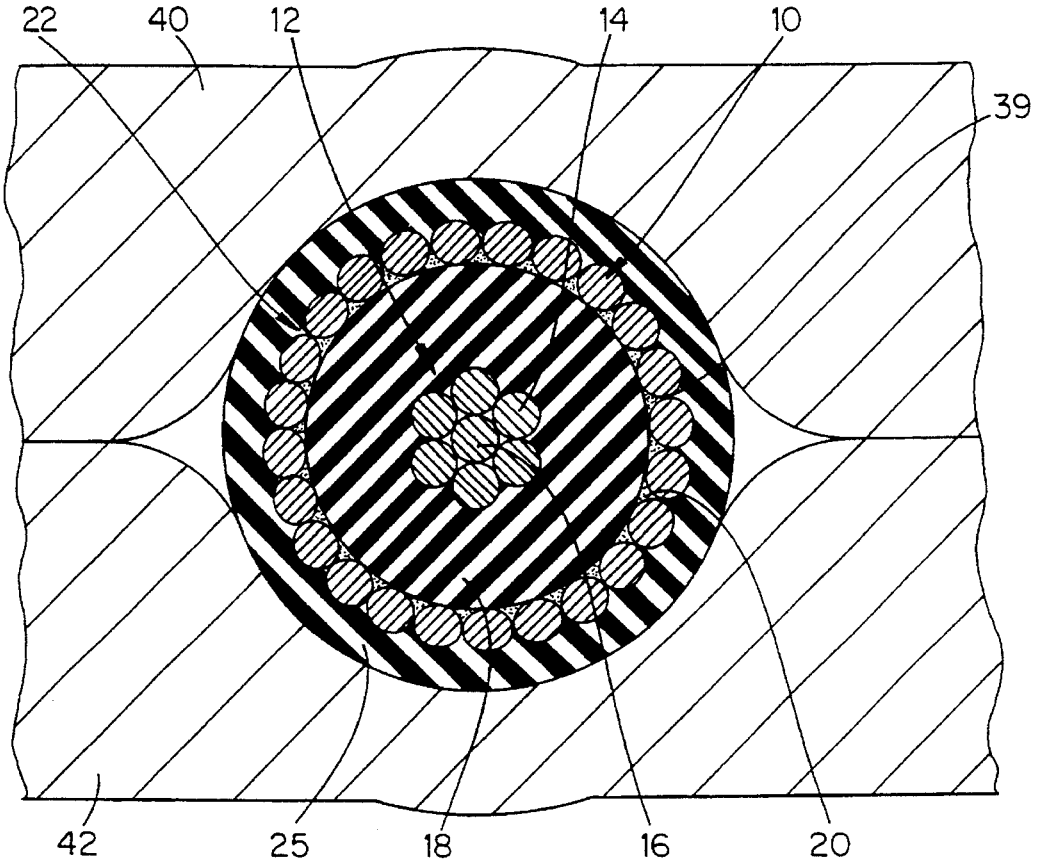
FIG. 1 shows a cross-sectional view of a coaxial heating cable of the invention embedded within a portion of an under-carpet mat.

Referring to FIG. 1, a coaxial heating cable 10 comprises a central conductive core 12 formed from six outer strands la of nickel-plated copper and a centre strand 16 of nickel. The six outer strands 14 are twisted helically around the centre strand 16. Each strand has a diameter of approximately 0.1 mm, the resultant overall diameter of the core being approximately 0.3 mm. The centre strand 16 may alternatively be formed from nickel steel. Further combinations are possible, providing that they result in a central conductive core having a resistance with a relatively high positive temperature coefficient (PTC) of at least 40% at 20° C. (a 0.4% increase in resistivity for every 1° C. increase in temperature) and a resistance of 0.35 ohms.

The nickel centre strand 16 provides additional strength to the central core 12. Furthermore, it provides a higher resistance without the need to change the outer diameter of the wire, and contributes to a higher PTC. The high PTC in the wire causes, in effect, self-regulation of the temperature of the wire. As the wire gets hotter, its resistivity increases, thereby reducing the flow of current, which leads to self-regulation. Further combinations allow a large range of specific resistances and PTC's, without the needs to change the physical dimensions of the various strands. The PTC and resistance of the core 12 may be varied by, for instance, providing a central nickel-plated copper strand having six nickel outer strands, resulting in the core 12 having a PTC of 50% and a specific resistance of 1.5 $ohmm^{-1}$ at 20° C.

Surrounding the core 12 is a polytetrafluoroethylene (PTFE) sheath 18, which is extruded over the core 12. The extruded PTFE sheath 18 has a thickness of between 0.15 mm and 0.25 mm, depending on the voltage rating required in the particular application.

Figure 2:
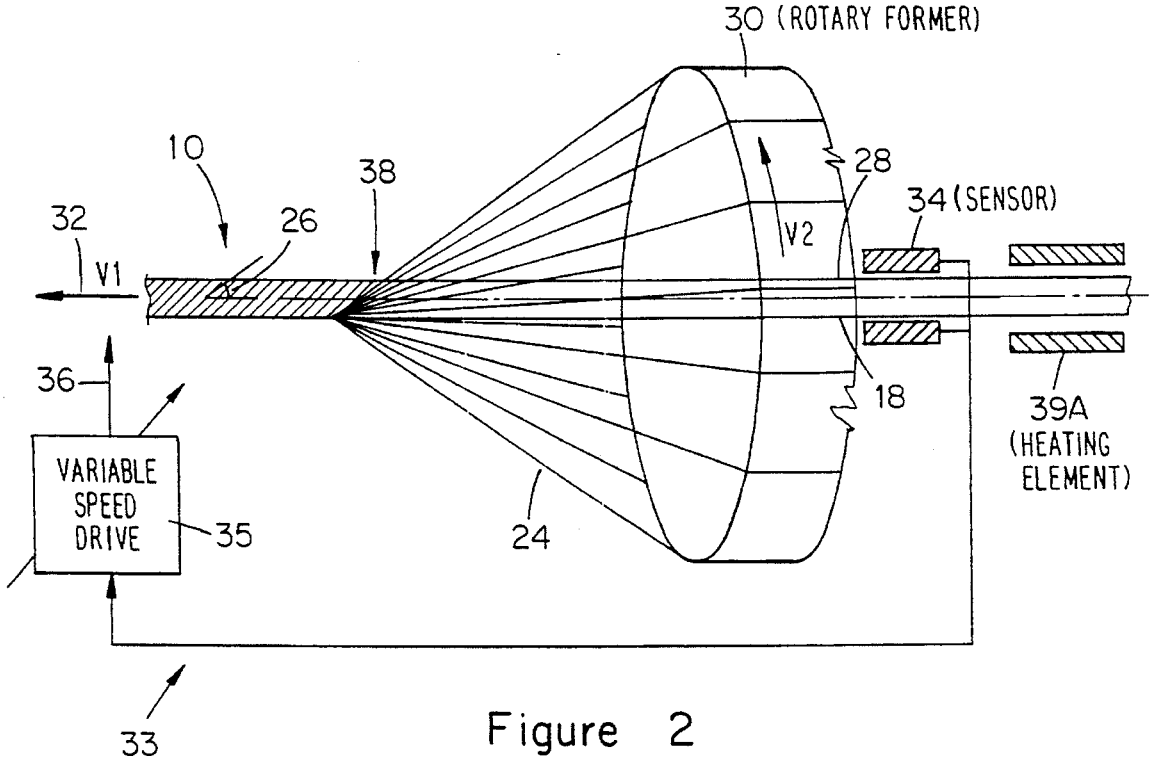
FIG. 2 shows a highly schematic view of a step in the manufacturing of the coaxial heating cable of FIG. 1.

Extrusion is achieved by the draw down vacuum method, ensuring a high degree of concentricity and good contact between the core and the sheath. After the PTFE sheath has been extruded over the central core 12, a layer of resinous lacquer having a thickness of approximately 3 microns is applied to the outer surface of the PTFE sheath 18, as is shown at 20. Stranded over the lacquer 20 is a shield 22 formed from twenty four contiguous tin-plated copper strands, each strand having a diameter of approximately 0.1 mm. As can be seen more clearly in FIG. 2, the individual strands 24 are helically laid round the PTFE sheath 18 at an average pitch angle 26 of about 20° relative to the central axis 28 of the cable. The strand wires 24 are fed freon a rotary former which is indicated in highly schematic form at 30, which rotates about the central axis 28. As the former rotates, the coaxial cable 10 is drawn axially in the direction of arrow 32 at a velocity V1.

A common problem associated with the extrusion of the PTFE sheath over a small core is that the thickness of the sheath may tend to vary by up to 10%. As a result, if the pitch angle were to remain constant, then the wire strands 24 would not cover the PTFE sheath 18 evenly or completely. In order to overcome this problem, a velocity control system 33 is provided, having a sensor 34 downstream of the rotary former 30 for constantly sensing the outer diameter of the PTFE sheath 18. A signal from the sensor 34 is transmitted to a variable speed drive 35, which has an output 36 for varying the axial velocity V1 of the cable 10.

As the velocity V2 of the rotary former 30 remains constant, the variable axial velocity V1 of the cable causes the pitch angle 26 of the strands 24 to vary as they are helically wound onto the PTFE sheath 18. Naturally, a delay factor corresponding to the time taken for the cable to travel from the sensor 34 to the point 38 where winding occurs is built into the velocity control system. Where the diameter of the PTFE sheath decreases, the velocity V1 is increased, thereby decreasing the pitch angle 26 so as to promote even coverage of the sheath 18 by the wire strands 24. On the other hand, if the diameter of the PTFE sheath 18 increases, the velocity V1 is reduced, thereby effectively increasing the pitch angle 26 and causing the wire strands 24 to cover the resultant greater cross-sectional area of the sheath 18 effectively. In an alternative embodiment, the speed V2 of the rotary former 30 may be varied in response to a change in diameter of the PTFE sheath 18, and the axial velocity V1 may be held constant.

By making use of either of the two methods described above, complete and constant coverage of the PTFE sheath 18 by the ground shield 22 is ensured, even though the shield comprises only a single layer of helically wound wire strands 24. Complete and constant coverage is further improved by preheating the sheath before covering.

A tubular heating element 39A, which is positioned just before the rotary former 30, will cause the sheath 18 to expand. Subsequent shrinkage of the sheath 18 after the strands 24 have been applied will cause any gaps which have developed between the strands to close, thereby increasing the contact between the strands 24, as well as the strand-to-sheath bonding.

In an alternative embodiment, lacquer is applied to outer nips 39 defined between the strands 24, thereby bonding the strands 24 firmly to one another around the sheath.

Figure 1A:
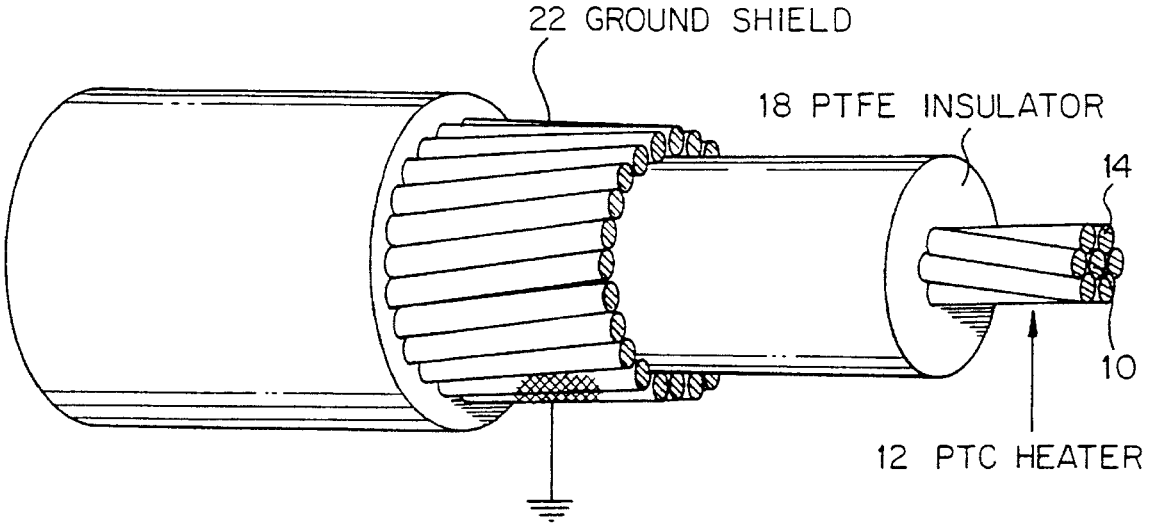
FIG. 1A shows a perspective view of the coaxial heating cable of FIG. 1.

Referring back to FIG. 1 and 1A, the resultant cable 10 is sandwiched between upper and lower layers of non-woven polyester material 40 and 42 which form part of an under-carpet heating mat. The relatively rough outer surface of the ground shield 22 prevents it from both lateral and axial movement within the cavity 44 formed between the layers 40 and 42. If lacquer is applied to fill the outer nips 39, then this also provides a bond between the ground shield 22 and the layers 40 and 42.

The almost 100% cover provided by the shield 22 provides total earth protection, as there are no air gaps or openings in the shield. This also leads to increased conductivity of the ground shield. A common problem associated with the drawing and stranding of very thin wires, such as those used in the heating core, is that variations in core diameter occurs, for instance due to elongation and relatively high drawing tolerances. So-called "hot-spots" will occur where there is a decrease in the diameter of the heating core, due to the localized increase in resistance. As the shield provides a uniform heat-conductive cover, it is able to dissipate heat effectively from such "hot-spots", thereby ensuring that there is a relatively constant heat dissipation over the length of the cable. By the use of only a single layer of wire strands 24, the diameter of the entire cable 10 is kept to a minimum, which in the particular embodiment described is approximately 0.9 mm. Consequently, the wires do not cause irregular bumps in the surface of the overlying carpet. In addition, owing to the relatively small diameter of the cable, heat may be transferred more efficiently from the core 12 through to the shield 22. Naturally, the shield 22 will be at a lower temperature than the core 12. This factor, in addition to the relatively high positive temperature coefficient of the core 12, results in a cable having a surface which is not prone to overheating in a well designed carpet heater, even when covered excessively.

During tests, it was found that the heating cable could stand excessive voltages and currents beyond its designed rating, Furthermore, the PTFE sheath is known to be resistant to most chemical solvents. In a fatigue test, no fatigue was encountered in the cable after a 65 000 cycle test in which the cable was bent to and fro. The cable of the invention is intended to operate at an outer surface temperature of no higher than 80° C., and has a nominal temperature rating of the PTFE sheath of 150° C. and a maximum temperature rating of 200° C. The cable is also resistant to fire, and is self-extinguishing.

In under-carpet heating applications, the cable is in the form of a continuous heating element having live and earth connections. A safety temperature sensor may be located on the ground shield for sensing local overheating, and can be used to break the continuity of the ground shield; a separate control device may be used to monitor the earth continuity and disconnect power in the case of a discontinuity arising. The control device can also be used to measure the variation in the earth shield resistance values, and to cut or reduce power in the event of the resistance values exceeding certain limits, long before self-destruction of the cable occurs.

As the strands making up the ground shield consist of approximately three times the amount of heat conductive metal by volume than is present in the core, and as the shield has a considerably greater outer surface area than the core, in local overheating, there is both sufficient tangential heat flow through the outer shield and sufficient axial heat flow along the length of the outer shield. In global overheating, the high PTC of the core would increase the resistance at such a rate that the decrease in current would result in a low heat output, thereby reducing the risk of such overheating by self-regulation of the current The contiguous strands of the earth shield permit tangential heat flow around the shield. In under-carpet heating applications, the uniform heat conductivity of the shield facilitates downward heat losses in the event of excessive coverage of the overlying carpet.

Since the heat transferring surface area of the shield is about three times that of the core material, the core would have to be considerably hotter than the surface of the shield to transfer the same quantity of heat. Furthermore, the PTFE layer effectively protects the core. If overheating of the core occurred, the electrical insulating properties of the PTFE would decrease, or the PTFE sheath would melt, thereby causing leakage to the ground shield. Power would thus be tripped out long before the surface temperature of the ground shield could increase to a point where it is dangerous. Destructive tests have shown that failure occurs at an outer surface temperature of approximately 170° C., at which stage the ground leakage current causes the power to trip. Consequently, a simple ground leakage device would adequately protect an under-carpet heating system, which employed the cable of the invention, against risk of fire and shock.

In lower temperature applications, the PTFE sheath could be replaced by a sheath of high melt polyvinylchloride (PVC), or other polymers designed to melt at a predetermined lower temperature than PTFE, without electrically degrading until such temperature is reached. For instance, electric blankets may have a PVC sheath which is designed to fail at a temperature of 70° C. At this temperature, the PVC sheath will melt, resulting in leakage to the ground shield.

The electrically conductive core may be formed from any number of strands. For instance, in applications where a coaxial cable having a diameter of 0.5 mm or less is required, a central core may be formed from a single strand having a diameter of 0.05 mm. Likewise, the thickness of the sheath may vary according to the voltage ratings required.

Additional protection of the cable may be provided by filling both the inner and outer nips of the strands 24 with lacquer. In addition, a thin layer 23 of a suitable polymer such as PTFE may be extruded or sprayed over the cable.

The conductive core could be altered so as to comprise nineteen strands, each having a diameter of 0.05 mm. Alternatively, a rayon or polyester centre core nickel strand or strands wound around it could be provided.

EXAMPLE 1

A coaxial heating cable was formed, having a core 12 comprising a centre strand 16 of 0.1 mm in diameter formed from nickel and surrounded by six outer strands 14, also of 0.1 mm in diameter, and formed from tin-plated copper. The core 12 was surrounded by an ethyl-tetrafluoroethylene (ETFE) sheath 18 having a thickness of 0.22 mm, which was in turn covered by an ground shield of twenty four contiguous tin-plated copper strands of 0.1 mm in diameter.

The overall length of the cable was 73 m, and the core had a positive temperature coefficient of 39% at 20° C., and a resistance of 0.316 $ohmm^{-1}$, leading to an overall cable resistance of 23.1 ohms. The cable was zig-zagged in a series of 57 parallel runs between upper and lower squares of non-woven polyester material 40 and 42, having 1.3 m sides, with the spacing between runs being 22 mm.

The following results were obtained, with measurements being taken at hourly intervals:

| | No Carpet | One Carpet (5 mm) | Two Carpets | Three Carpets | Three Carpets Three Under-felts |
|---|---|---|---|---|---|
| VOLTS | 110 | 110 | 110 | 110 | 110 |
| AMPS | 3.95 | 3.85 | 3.75 | 3.73 | 3.67 |
| RESIST-ANCE | 27.84 | 28.57 | 29.33 | 29.49 | 29.97 |
| WATTS | 434.5 | 423.5 | 412.5 | 410.3 | 403.7 |
| $WATTS/M^2$ | 167.1 | 163.6 | 158.6 | 157.8 | 155.26 |

-continued

| | No Carpet | One Carpet (5 mm) | Two Carpets | Three Carpets | Three Carpets Three Under-felts |
|---|---|---|---|---|---|
| WATTS/M | 5.95 | 5.8 | 5.65 | 5.62 | 5.53 |
| LIVE TO GROUND LEAKAGE (mA) | 0.02 | 0.02 | 0.02 | 0.02 | 0.02 |
| TEMP START | 18.3 | 17.9 | 17.5 | 17.1 | 19 |
| TEMP MEASUR-ED | 17.9 | 17.5 | 17.1 | 17 | 18.5 |
| TEMP UNDER CARPET ON ELE-MENT | 0 | 53.8 | 68.5 | 72.6 | 79.9 |
| TEMP UNDER CARPET BETWEEN ELEMENT | 0 | 39.5 | 54.6 | 60.9 | 68.2 |
| TEMP ON CARPET ON ELE-MENT | 50.8 | 25.8 | 24.3 | 24 | 22.4 |
| TEMP ON CARPET BETWEEN ELEMENT | 19.8 | 24 | 22.6 | 22.7 | 22.4 |

EXAMPLE 2

An under-carpet heater having an area of 2 $m^2$ is required, having a power output at the legal limit of 165 $Wm^{-2}$. For a 5 mm thick carpet, at a desired power output of 6 $Wm^{-1}$, an 85° C. core temperature is selected. This is 65° C. above an average ambient temperature of 20° C. At an applied voltage of 220V, the current is (165 $Wm^{-1}$×2 $m^2$)/220V=1.5A, and the total resistance is 220V/1.5A=147 ohms. At an output of 6.5$Wm^{-1}$, for a total power output of 330W, the cable length is 330W/6.5$Wm^{-1}$=51 m. The resistance per meter of cable is thus 147 ohms/5 m=2.9 $ohmsm^{-1}$at 85° C. Applying a correction factor or PTC of 60%, the adjusted temperature difference is 65°Cx0,6=39.° C. The required resistance per meter is thus 100 (2.9 $ohmsm^{-1}$ /139)=2.07 $ohmsm^{-1}$ at 20° C.

The coaxial heating cable of the invention has numerous applications, and can be used, inter alia, in under-blanket heating, under-textile heating the heating of ceramics such as tiles, electric foot warmers, the heating of car seats, aquarium heating, breeding pad heating, heating in agricultural applications and the heating of clothing.

I claim:

1. A flexible coaxial space heater cable comprising a central electrically conductive multistrand heating core formed from a plurality of strands so as to provide a metallic conductor having a resistance with a positive temperature coefficient, an electrically insulating polymeric sheath surrounding the core, and an outer electrically conductive ground shield enclosing the polymeric sheath, the ground shield comprising a plurality of contiguous strands which are helically laid over the polymeric sheath, wherein said flexible coaxial space heater cable has a maximum diameter of 1.5 mm, wherein the contiguous strands are helically laid over the polymeric sheath at a varying pitch angle along the length of the polymeric sheath, in concert with variations in an outer diameter of the polymeric sheath along the length thereof, so as to provide constant and complete coverage of the polymeric sheath and to facilitate tangential heat flow around the ground shield.

2. The coaxial space heater cable according to claim 1 in which the conductive multistrand core has a central strand formed from a first conductive material and at least six outer strands formed from a second conductive material which is different from the first conductive material.

3. The coaxial space heater cable according to claim 2 in which first conductive material is selected from a group including copper, nickel-plated copper, tin-plated copper, and nickel.

4. The coaxial space heater cable according to claim 1 in which the metallic conductor has a positive temperature coefficient of at least 40% at 20° C., and a minimum resistivity of 0.3 $ohmm^{-1}$ at 20° C.

5. The flexible coaxial space heater cable according to claim 1 in which the average of the varying pitch angle relative to a central axis of the cable is approximately 20°.

6. The flexible coaxial space heater cable according to claim 1 in which the polymeric sheath is an extruded PTFE sheath having a thickness from 0.15 mm to 0.25 mm.

7. The flexible coaxial spaced heater cable according to claim 1 in which each of the strands of the multistrand core and each of the contiguous strands of the shield have a maximum diameter of approximately 0.1 mm.

8. The flexible coaxial spaced heater cable according to claim 1 in which the cable is sandwiched in a serpentine configuration between adjacent material layers which form part of an under-carpet heating mat.

9. A flexible coaxial space heater cable comprising a central electrically conductive heating core formed from a metallic conductor having a resistance with a positive temperature coefficient, an electrically insulating polymeric sheath surrounding the core, and an outer electrically conductive ground shield enclosing the polymeric sheath, the ground shield comprising a plurality of contiguous strands which are helically laid over the polymeric sheath, wherein the conductive core is a multistrand core having a central strand from a first conductive material and a plurality of outer strands formed from a second conductive material which is different from the first conductive material, the first conductive material being chosen from a group including copper, nickel-plated copper, tin-plated copper, and nickel, and the second conductive material being chosen from a group including nickel, copper, nickel-plated copper and tin-plated copper, insofar as the second conductive material is not identical to the first conductive material.

10. The coaxial space heater cable according to claim 9 in which the central strand is formed from nickel and the outer strands are formed from nickel-plated copper.

* * * * *